United States Patent [19]

Rongoe, Jr.

[11] Patent Number: 4,741,138

[45] Date of Patent: May 3, 1988

[54] GIRDER SYSTEM

[76] Inventor: James Rongoe, Jr., 52 Strawberry Hill Ct., Stamford, Conn. 06902

[21] Appl. No.: 870,777

[22] Filed: Jun. 3, 1986

Related U.S. Application Data

[63] Continuation of Ser. No. 586,418, Mar. 5, 1984, Pat. No. 4,597,233.

[51] Int. Cl.[4] ..... E04B 1/16

[52] U.S. Cl. ..... 52/334; 52/336

[58] Field of Search ..... 52/327, 333, 334, 336, 52/340, 341, 368, 373, 376, 632, 722–740

[56] References Cited

U.S. PATENT DOCUMENTS

| | | | |
|---|---|---|---|
| 1,778,337 | 10/1930 | Pratt | 52/483 |
| 2,663,270 | 12/1953 | Friedly | 52/483 |
| 2,788,122 | 4/1957 | Kennedy | 206/321 |
| 3,094,813 | 6/1963 | Saxe | 52/344 |
| 3,210,900 | 10/1965 | Sattler | 52/334 |
| 3,307,304 | 3/1967 | Klausner | 52/99 |
| 3,372,523 | 3/1968 | Hall, Jr. | 52/699 |
| 3,392,499 | 7/1968 | McManus | 52/483 |
| 3,527,007 | 9/1970 | McManus | 52/327 |
| 3,624,980 | 12/1971 | McManus | 52/327 |
| 3,683,580 | 8/1972 | McManus | 52/334 |
| 3,728,835 | 4/1973 | McManus | 52/334 |
| 3,812,636 | 5/1974 | Albrecht et al. | 52/334 |
| 4,259,822 | 4/1981 | McManus | 52/334 |
| 4,295,310 | 10/1981 | McManus | 52/334 |
| 4,335,557 | 6/1982 | Morton | 52/741 |
| 4,432,178 | 2/1984 | Taft | 52/334 |
| 4,457,115 | 7/1984 | Grearson et al. | 52/73 |
| 4,483,118 | 11/1984 | Betschart | 52/648 |
| 4,483,119 | 11/1984 | Hernandez | 52/689 |
| 4,597,233 | 7/1986 | Rongoe, Jr. | 52/334 |

*Primary Examiner*—John E. Murtagh
*Assistant Examiner*—Andrew Joseph Rudy
*Attorney, Agent, or Firm*—F. Eugene Davis, IV; Mark P. Stone

[57] ABSTRACT

A construction of girder and joist supports for framed concrete slabs wherein continuous metal decking and standard joists are used and wherein rigid connections are established between the concrete and the girders by means of shear connectors which are embedded in the concrete and connected to extensions fixed to the tops of the girders.

11 Claims, 3 Drawing Sheets

GIRDER SYSTEM

This is a continuation of U.S. Ser. No. 586,418 filed on Mar. 5, 1984, now U.S. Pat. No. 4,597,233 issued on July 1, 1986.

This invention relates to the construction of girder and joist supports for framed concrete slabs.

BACKGROUND OF THE INVENTION

One common means of framed concrete slab construction is achieved by pouring concrete onto decking constituted by sheets of corrugated metal. The metal decking is supported by steel girders such as suitably spaced beams. When metal decking is attached directly to the girders, it is common practice to attach headed steel studs to the girders, which studs extend upward through the metal sheets. These studs are usually welded to the beams. When concrete is poured onto the metal decking, it flows around the studs and after it hardens it forms a bond or lock with the girders by virtue of its solidifying around the head portions of the studs, a structurally more efficient assembly is achieved than if the girder acted independently. This is commonly known as "composite construction".

Another common method of framing concrete slabs consists of the use of standard web steel joists which support the metal deck and in turn bear or sit upon steel girders. In this type of assembly, the decking is usually attached directly to the joists and does not make direct contact with the girder, because the joists sit upon the top flange of the girder. As a result, there is an air space or gap between the bottom of the deck and the top flange of the girder. Consequently, no direct bond between the concrete and the girders can be taken advantage of as in the structure which utilizes the metal studs for this purpose. To achieve composite action between the girder and concrete slab when joists are utilized, in one type of construction, the metal deck is discontinued over the girder and sloped or pitched down to the top flange of the girder on order to establish contact between the girder and concrete slab. Another current practice is to eliminate the metal decking and form the slab on plywood, using special joists which protrude into the slab. This also results in connection of the girder with the concrete slab. Since connection is now established, studs may additionally be utilized to achieve composite action between the steel girder and concrete slab.

SUMMARY OF THE INVENTION

The invention resides in a novel means for providing a bond between the concrete and the girders when a standard steel joist system is utilized. It consists in providing a series of extensions which are attached to the top flange of the girder at positions intermediate the joists and which extend to the bottom of the metal decking when the decking is placed on top of the joists. Holes are made in the decking and shear connectors such as studs are welded to the extensions. The connectors form a lock or bond with the concrete and the girder when the concrete solidifies to achieve composite action. The invention lies principally in providing extensions from the girder, through the decking and into the concrete, in an assembly utilizing girders, standard joists bearing on top of the girders, and metal decking onto which concrete is poured. By use of these extensions, the air space or gap between the bottom of the deck and the top flange of the girder is now occupied by a structural element, and composite action between the girders and the concrete results.

The invention accordingly comprises the features of construction, combination of elements, and arrangement of parts which will be exemplified in the construction hereinafter set forth, and the scope of the invention will be indicated in the claims.

DESCRIPTION OF THE PREFERRED EMBODIMENTS

Figure 1:
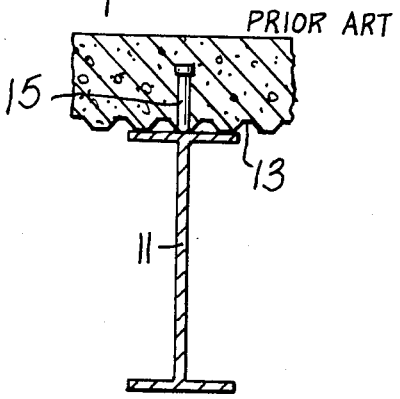
FIG. 1 is a sectional view of a girder with metal decking, a stud through the decking and concrete on top of the decking, as in the prior art.
Figure 2:
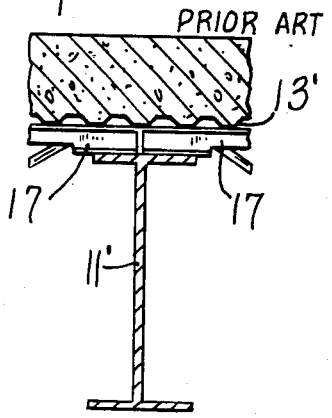
FIG. 2 is a sectional view of a girder with a joist, decking atop the joist, and concrete on top of the decking, as in the prior art.

FIG. 1 shows a prior art means for framing concrete slabs without the use of joists. Girder 11 supports corrugated metal decking sheets 13. Studs 15 are welded to and project upward from the girder and form a bond with the concrete when it is poured onto the decking sheets 13. In FIG. 2 is shown an alternative means for framing concrete slabs which is also known in the prior art. Girder 11' supports joists 17 which in turn support corrugated metal decking sheets 13'. In such an installation, however, there is no direct bond between the girder and the concrete, since the joist bears on top of the girder.

Figure 3:
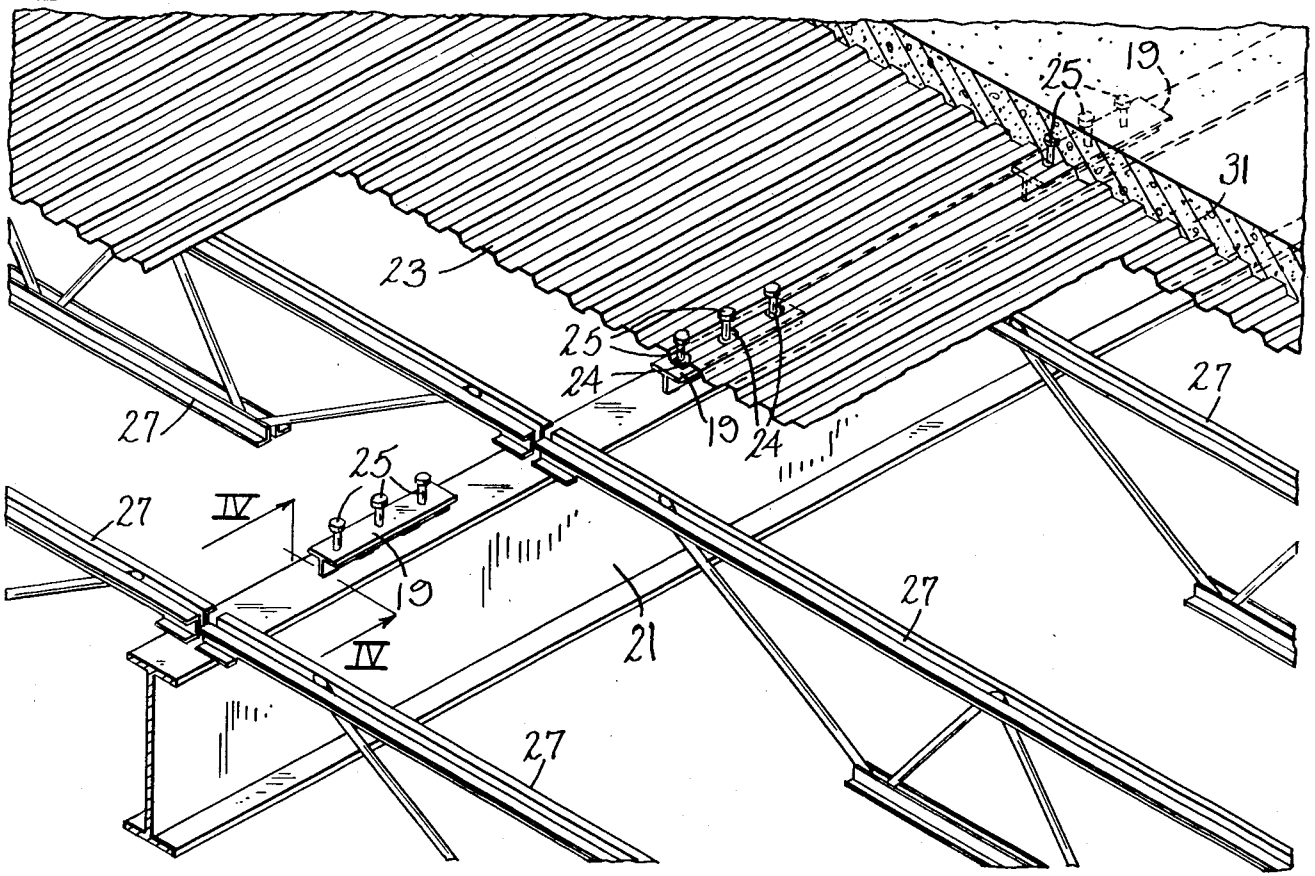
FIG. 3 is a perspective view, partially in section and partially broken away, of an assembly for construction of framed concrete slab, showing a standard joist, decking supported on the joist, and concrete on the decking, a tee being welded on the top of the girder and a stud being welded to the top of the tee to extend into the concrete.
Figure 4:
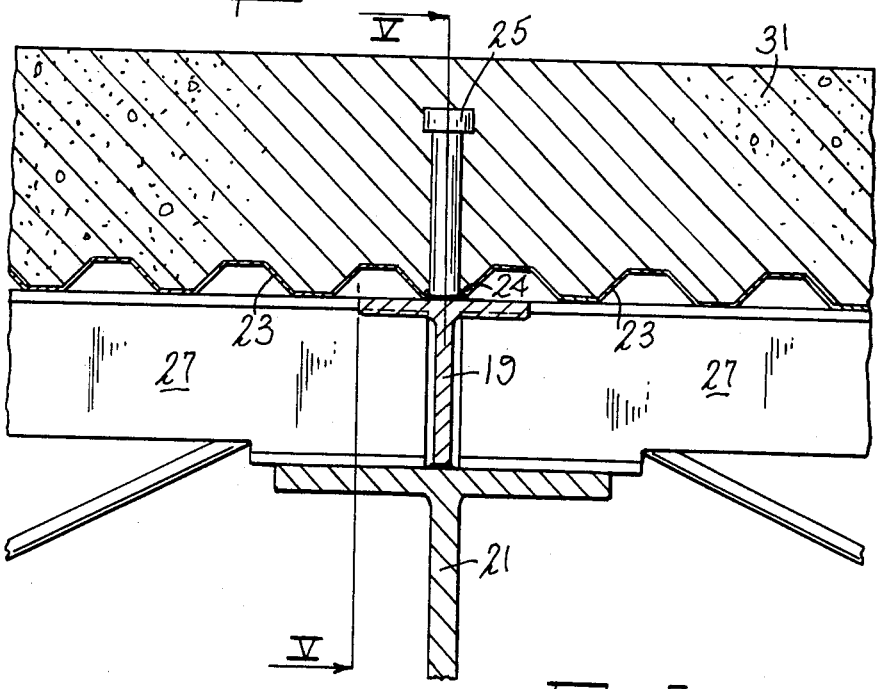
FIG. 4 is a sectional view on the line IV—IV of FIG. 3.
Figure 5:
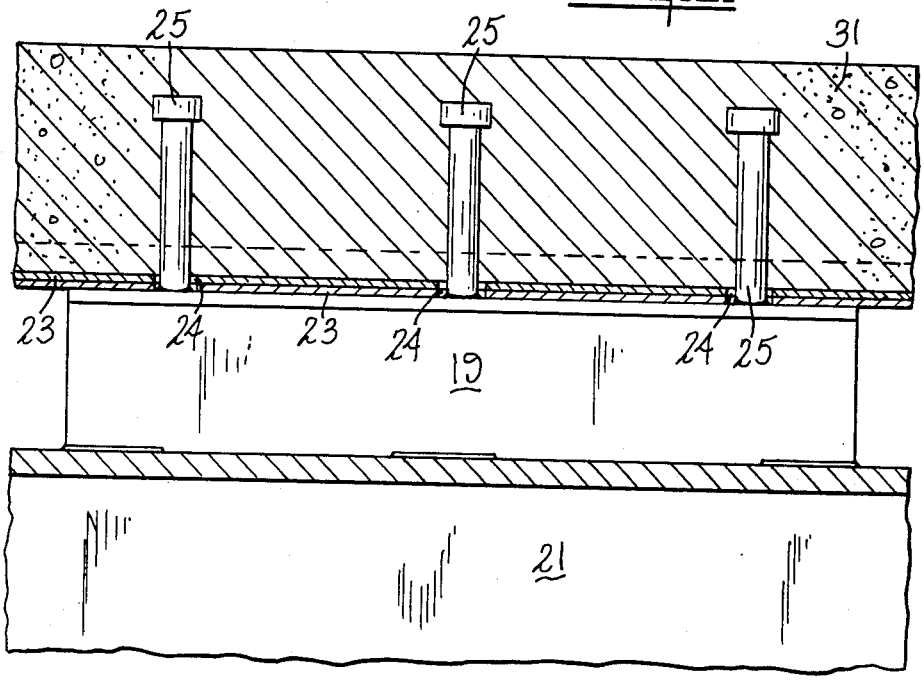
FIG. 5 is a sectional view on the line V—V of FIG. 4.

FIG. 3 shows the means for constructing concrete slabs and which includes the invention. In this embodiment a steel tee 19 is welded to the girder 21 and shear connectors in the form of studs 25 are welded to the tee 19. Standard steel joists 27 are placed at appropriate intervals across the tops of the girders 21. The tees are equal in height to the distance from the top of the girder 21 to the top of the joists 27 so that the decking sheets 23 rest on the joists and the tees. Since the upper surfaces of the tees lie in the same plane as the surfaces of the joists, the decking sheets can rest on the tees. The studs 25 extend above the tees and into the concrete 31 when the concrete is poured over the sheets 23. Thus a direct bond is formed between the concrete 31 and the girders 21 by use of studs 25 and tees 19 which connect the concrete to the girder, creating composite action. The studs 25 can be attached to the tees either before or after assembly of the sheets 23 onto the joists 27. They are usually welded onto the tees and this can be done either at the plant or on the job site depending on which is more convenient. Conventional reinforcement material (e.g. mesh or rods, not shown) will normally be introduced into the concrete when it is poured.

The use of T-shaped members or studs is not a requirement of the invention. Any upward extension of the girder which permits use of a shear connector will effect the purposes of the invention.

Figure 8:
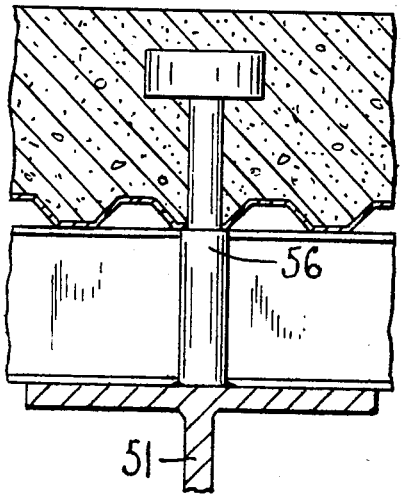
FIGS. 6, 7 and 8 are sectional views of a beam with various alternative shapes and designs of the invention.
Figure 6:
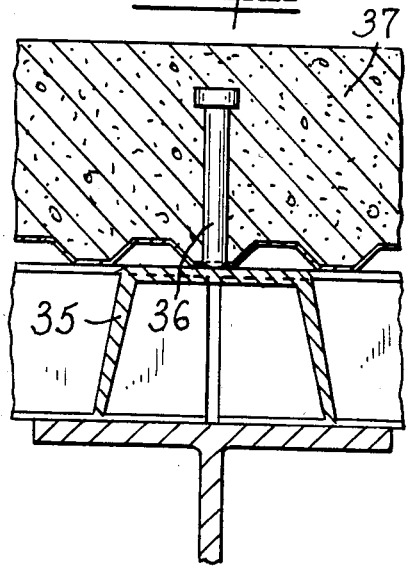
Figure 7:
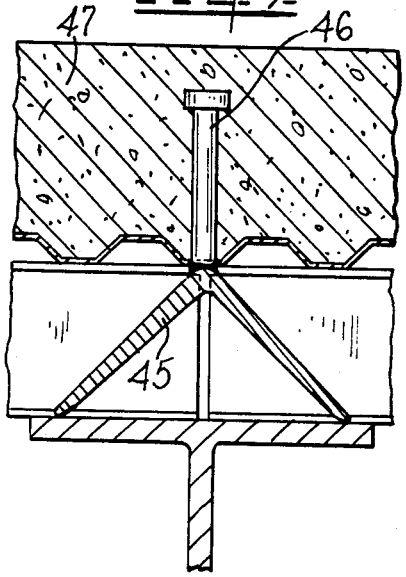

FIG. 6 shows an inverted C-shaped or channel member 35 with stud 36 welded thereto and extending into concrete 37 and FIG. 7 shows an inverted L-shaped member 45 with stud 46 welded thereto and extending into concrete 47. These T, C and L-shaped members provide support for the studs 25, 36 and 46 and connect the studs rigidly with the girders, through the zone occupied by joists. As a further alternative, FIG. 8 shows girder 51 with a one piece elongated tee connector 56 which does not utilize any intermediate support member. Any of these embodiments will serve the purpose of the invention which is to form a bond or lock between the girder and the concrete.

As clearly shown in FIG. 3, each stud-bearing tee may be only a few inches long and mounted on a girder at a point midway between adjacent joists; this same distribution of slab-locking studs can be effected in the location of the inverted C or L-shaped members.

The structure disclosed herein makes possible the use of shallower girders and/or girders of less weight or size while still getting adequate strength due to the tying of the concrete slab directly and positively to the girder (i.e. composite action).

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What is claimed is:

1. A framed concrete slab structure comprising at least one girder having an upper surface, at least one joist intersecting said at least one girder along the upper surface of said at least one girder, said at least one joist being supported by the upper surface of said at least one girder, and continuous deck means disposed to rest on said joist spaced above said girder by said joist and adapted to receive poured concrete thereon, shear connector mounting means mounted on said upper surface of said at least one girder and spaced away and separate from said joist, said shear connector mounting means projecting upwardly from said upper surface of said at least one girder, and a shear connector mounted to said shear connector mounting means and projecting upwardly therefrom, said shear connector having an upper portion thereof extending through an opening defined in said continuous deck means so that said upper portion of said shear connector is adapted to be embedded in said poured concrete on said deck means.

2. A framed concrete slab structure according to claim 1 wherein each rigid shear connector mounting means has a length shorter than the distance between joists and is provided with a plurality of shear connectors.

3. A framed concrete slab structure according to claim 1 wherein said shear connector mounting means is of T-shaped vertical cross-section having its stem welded to the upper surface of the at least one girder and the shear connectors being welded on the top of the T-shaped mounting means.

4. A framed concrete slab structure according to claim 1 wherein said shear connector mounting means is of inverted C-shaped vertical cross-section, having its lower edges welded to the upper surface of the at least one girder and the shear connectors being welded on top of the C-shaped mounting means.

5. A framed concrete slab structure according to claim 1 wherein said shear connector mounting means is of inverted L-shaped vertical cross-section, having its lower edges welded to the upper surface of at least one girder and the shear connectors being welded on the upward directed vertex of the L-shaped mounting means.

6. The structure as claimed in claim 1 wherein said shear connector mounting means are laterally spaced away from said joist.

7. A framed concrete slab structure according to claim 1 wherein a rigid shear connector mounting means is located in each space between joists.

8. A framed concrete slab structure comprising at least one girder having an upper surface, at least one joist intersecting said at least one girder along the upper surface of said at least one girder, said at least one joist being supported by the upper surface of said at least one girder, and continuous deck means disposed to rest on said joist spaced above said girder by said joist and adapted to receive poured concrete thereon, shear connector means mounted on said upper surface of said at least one girder and projecting upwardly therefrom, said shear connector means being spaced away and separate from said joist on said upper surface of said girder,.

said shear connector means having a portion extending through at least one opening provided in said continuous deck means, said portion of said shear connector means extending through said opening being adapted to become embedded in said poured concrete on said deck means.

9. The structure as claimed in claim 8 wherein said shear connector means are laterally spaced away from said joist.

10. A framed concrete slab structure according to claim 8 wherein said shear connector means includes at least two different sections having different cross sectional dimensions.

11. A framed concrete slab structure according to claim 10 wherein a first lower section of said shear connector means has a cross section larger than said opening in said deck means and a second upper section of said shear connector means has a cross section smaller than said opening in said deck means.

* * * * *